US006279171B1

(12) United States Patent
Brancato

(10) Patent No.: US 6,279,171 B1
(45) Date of Patent: Aug. 28, 2001

(54) DECORATIVE GARMENT SUPPORT

(75) Inventor: Theresa M. Brancato, Commack, NY (US)

(73) Assignee: Creative Mines, LLC, Deer Park, NY (US)

( * ) Notice: Subject to any disclaimer, the term of this patent is extended or adjusted under 35 U.S.C. 154(b) by 0 days.

(21) Appl. No.: 09/448,550

(22) Filed: Nov. 23, 1999

(51) Int. Cl.[7] ..... A41F 15/00
(52) U.S. Cl. ..... 2/326
(58) Field of Search ..... 2/325, 327, 328, 2/329, 330, 331, 326, 332, 333, 323, 110, 217, 300, 305, 310, 243.1, 244; 450/59, 60, 63, 64, 86, 88, 28; D2/703, 705, 708, 723, 793, 794; 24/298; 63/39, 38

(56) References Cited

U.S. PATENT DOCUMENTS

| | | | | |
|---|---|---|---|---|
| 197,015 | * | 11/1877 | Calm | 2/323 |
| 350,774 | | 10/1886 | Seel . | |
| D. 363,042 | * | 10/1995 | Papernik et al. | D11/86 |
| D. 393,183 | * | 4/1998 | Kurtzman | D7/633 |
| 686,068 | | 11/1901 | Herrick et al. . | |
| 1,457,350 | | 6/1923 | Damiano . | |
| 1,491,578 | | 7/1924 | Ballou et al. . | |
| 1,632,716 | * | 6/1927 | Schweigert | 2/323 |
| 1,683,545 | | 12/1928 | Harris . | |
| 1,896,029 | * | 1/1933 | Gunther | 24/3.11 |
| 2,849,723 | * | 9/1958 | Marino | 2/323 |
| 2,923,011 | * | 2/1960 | Findeisen | 2/325 |
| 3,142,844 | * | 8/1964 | Murray | 2/326 |
| 3,456,457 | | 7/1969 | Cass . | |
| 3,520,001 | | 7/1970 | Chancellor, Jr. . | |
| 3,701,166 | | 10/1972 | Lindblom . | |
| 3,708,804 | | 1/1973 | Santos . | |
| 4,885,805 | | 12/1989 | Mason . | |
| 5,117,538 | * | 6/1992 | Henry | 24/298 |
| 5,386,710 | | 2/1995 | Moore . | |
| 5,526,654 | | 6/1996 | Carter . | |
| 5,535,448 | | 7/1996 | Williamson . | |
| 5,713,080 | | 2/1998 | Tate . | |
| 6,006,365 | * | 12/1999 | Strandberg | 2/329 |
| 6,027,213 | * | 2/2000 | Ignatowski | 351/52 |

* cited by examiner

*Primary Examiner*—John J. Calvert
*Assistant Examiner*—Alissa L. Hoey
(74) *Attorney, Agent, or Firm*—Galgano & Burke

(57) ABSTRACT

Ornamental jewelry supports for garments, particularly for upper torso garments worn by women such as bras, bikini tops, halters, strapless dresses, and the like. The garment supports are adjustable along their length with adjusting mechanisms that do not result in unsightly overlap of the ornamental lengths of jewelry of the present garment supports. The adjustable ornamental garment supports can be readily moved from one garment to another and do not require puncturing the garment.

69 Claims, 5 Drawing Sheets

DECORATIVE GARMENT SUPPORT

The present invention is directed to decorative garment supports which provide ornamental, accessory items while supporting a garment.

BACKGROUND OF THE INVENTION

Jewelry has been used previously to support women's garments. For example, as early as 1924, U.S. Pat. No. 1,491,578 to Ballou discloses the use of chains made of precious metal, pearls, beads or ribbons for supporting garments. Since different garments may be cut differently, and people are different sizes, there is a need to adjust a garment support. The Ballou patent utilizes a highly visible mechanism wherein each length of support is overlapped upon itself and adjusted in order to obtain the desired length.

Other previously known supports were often not adjustable or are not interchangeable between garments. For example, one previously known garment support shown in FIG. 1 comprises a length of shiny chain links. The front section of each bra support is sewn to the bra 20 at the uppermost portion of each cup 11, 11'. Two separate rear links are also sewn to the back of the bra at intermediate positions 12, 12'. Attached to the terminal end of the rear chain lengths 15 are fasteners designed to releasably connect with an intermediate portion of the longer length of (front) chain links. As illustrated in FIG. 1, however, this arrangement results in excess chain links 13, 13' dangling visibly on the back of the person utilizing this garment support. This illustrated garment support is also not readily interchangeable between garments since it is sewn to the bra 20 at 4 separate points. (11, 11', 12, and 12')

It is most desirable to provide a garment support which is readily interchangeable between garments. While the garment support disclosed in the Ballou patent is interchangeable, it utilizes safety pins which can readily tear or damage a garment. The entire adjustment mechanism is also visible.

There is a need for a garment support, particularly useful for woman's upper garments such as bras, dresses, halters, and the like which do not have over-the-shoulder or around-the-neck supports for holding the garment at the desired height. It would therefore be desirable to provide attractive, ornamental jewelry-type garment supports which do not require overlap of each length of the garment support in order to provide desired adjustability and which are readily interchangeable between different garments without requiring sewing or otherwise puncturing the garment.

SUMMARY OF THE INVENTION

The various embodiments of the present invention provide improved ornamental jewelry supports for garments, particularly for upper torso garments worn by women such as bras, bikini tops, halters, strapless dresses, dresses with thin straps, strapless tops, tops with thin straps, and the like. Various aspects of the invention advantageously provide adjustable ornamental garment supports which can readily be moved from one garment to another and which, most preferably, do not require puncturing the garment with pins, posts, buttons or which otherwise require modification of the garment. The garment supports of the present invention are advantageously adjustable along their length in order to permit the person wearing the garment to adjust the height of the garment relative to the wearer's shoulders or neck. Unlike some previously disclosed garment supports, the adjusting mechanisms of the present invention do not result in unsightly overlap of the ornamental lengths of jewelry of the present garment. supports. To the extent that adjustment results in an excess length of the garment support, that excess length is substantially concealed between the garment and the body of the person. Certain embodiments of the present invention comprise a releasable clasp for releasably connecting one end of the garment support to a garment and a second connector having a clasp which is attachable to an intermediate length of the garment.

These and other embodiments are described along with reference to the drawings.

DETAILED DESCRIPTION

The various embodiments of the present invention provide improvements with respect to previously known ornamental garment supports.

Figure 1:
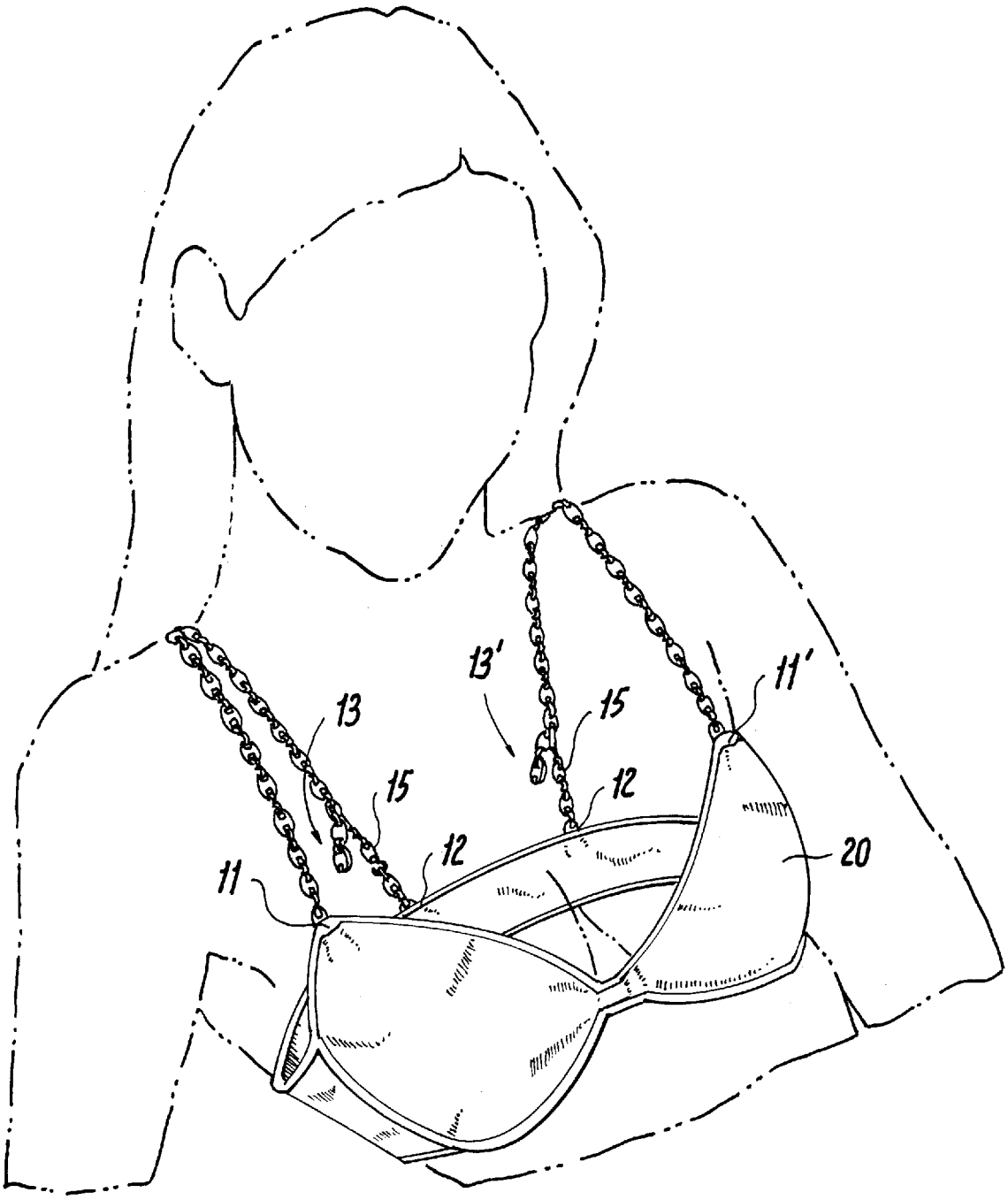
FIG. 1 (Prior Art)
FIG. 1 illustrates a previously known ornamental garment support.
Figure 2:
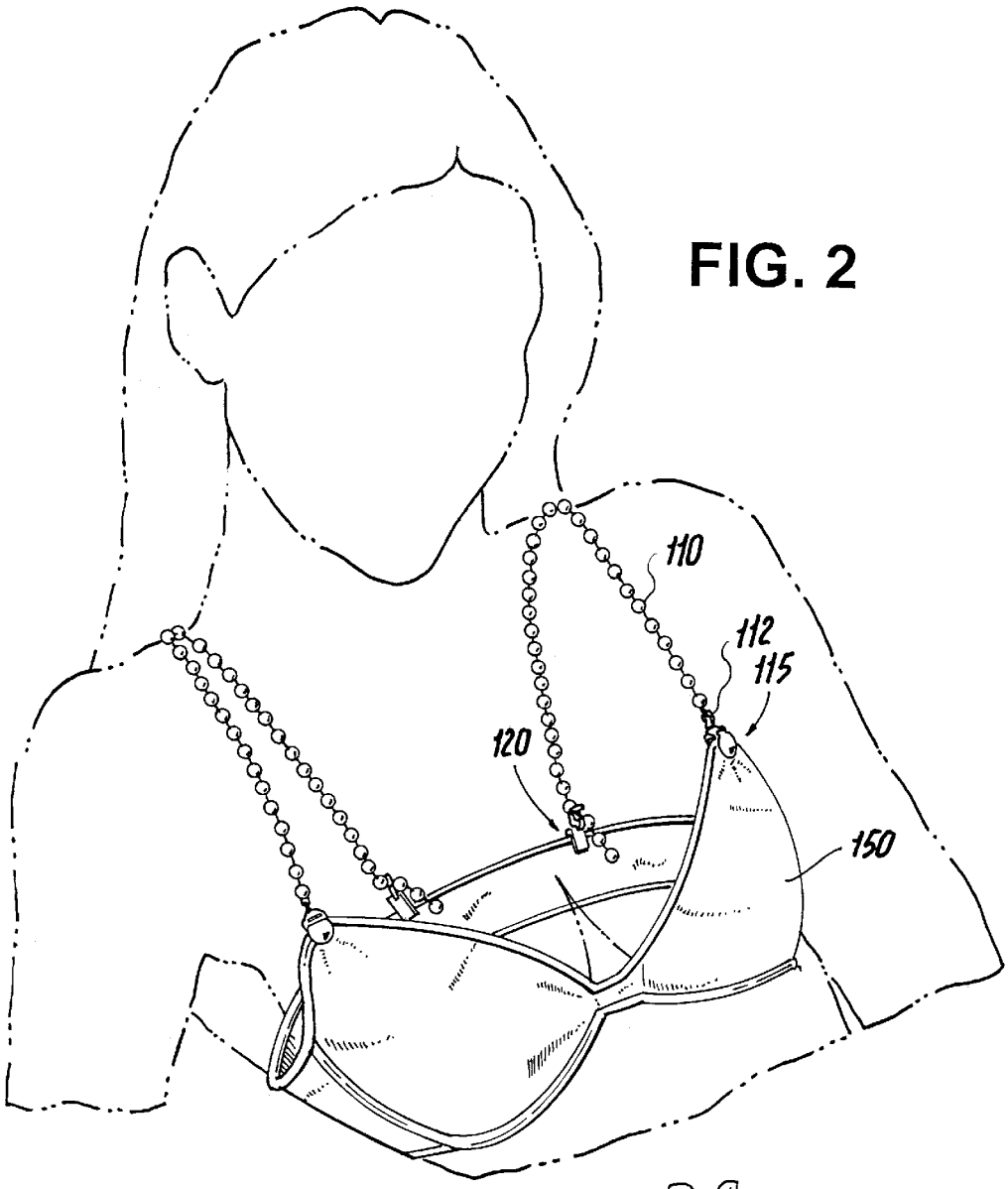
FIG. 2 is a perspective view of a garment support of one embodiment of the present invention connected to a bra with a woman shown in a phantom.
Figure 3:
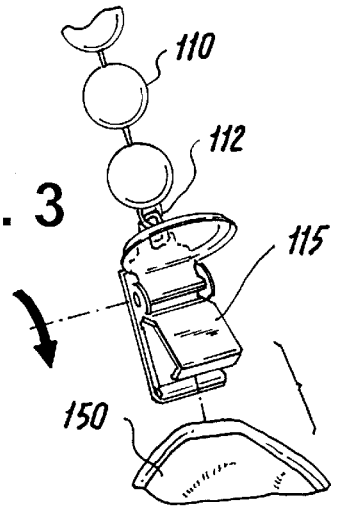
FIG. 3 illustrates a front clasp of the embodiment illustrated in FIG. 2.
Figure 4:
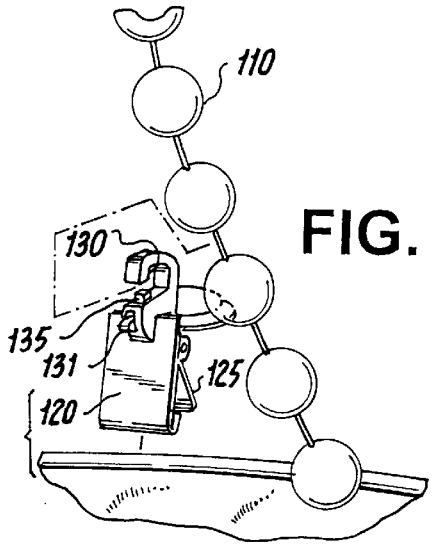
FIG. 4 illustrates an unattached rear clasp of the embodiment illustrated in FIG. 2.

FIGS. 2–4 illustrate one embodiment of the present invention which substantially eliminates the unattractive overlap between garment support sections and is designed to facilitate quick interchangeability from one garment to another. In this illustrated embodiment, a length of beads or pearls 110 has a forward terminal end 112 to which is attached a readily positionable and removable garment clasp 115. As shown in FIG. 2, this clasp 115 can readily be connected to the top of a bra cup 150 or some other garment such as a strapless dress, halter, bathing suit, etc. Clasp 115 advantageously avoids puncturing the garment 150 so as to avoid any damage, according to this preferred illustrated embodiment. While the illustrated clasp is one preferred embodiment, it is also within the scope of the present invention to use other clasps having different shapes and sizes, provided that they do not pierce the garment.

In order to provide adjustability to the garment support 110 for use with different garments or by different people, a rear connector 120 comprises a first garment clasp 125 for attachment to a garment and a connector 130 for releasably and selectively attaching rear clasp 120 to the length of jewelry 110. The lower garment attaching clasp 125 and the length of jewelry connector 130 are best shown in FIG. 4.

According to this illustrated embodiment, when the pin 131 of the hook connector 130 is moved downwardly the trigger 135 is depressed, thereby opening the hook connector for attaching the length of jewelry 110 or releasing the length of jewelry 110 from the connector. The rear clasp 120, of this illustrated embodiment, is also designed to avoid any damage to the garments. This illustrated embodiment of the present invention advantageously avoids the overlap of the length of beads or pearls of a single strand. Excess strands are advantageously concealed from view between garment and the body of the wearer. While the illustrated adjustment mechanism is one preferred embodiment, it is also within the scope of the present invention to use other adjustment mechanisms having different shapes and sizes, provided that they are selectively attachable to and releasable from the length of jewelry.

The particular design of the jewelry is not limited to any one embodiment. As used herein, the term "length of jewelry" is used to indicate any fabrics, precious gems, semi-precious gems, costume jewelry, diamonds, chains, beads, pearls, metals, precious metals, or any other suitable materials, in various designs, shapes, and/or colors and any combinations thereof, regardless of cost. As noted, the embodiment illustrated in FIGS. 2–4 can comprise beads, pearls, and the like.

Figure 5:
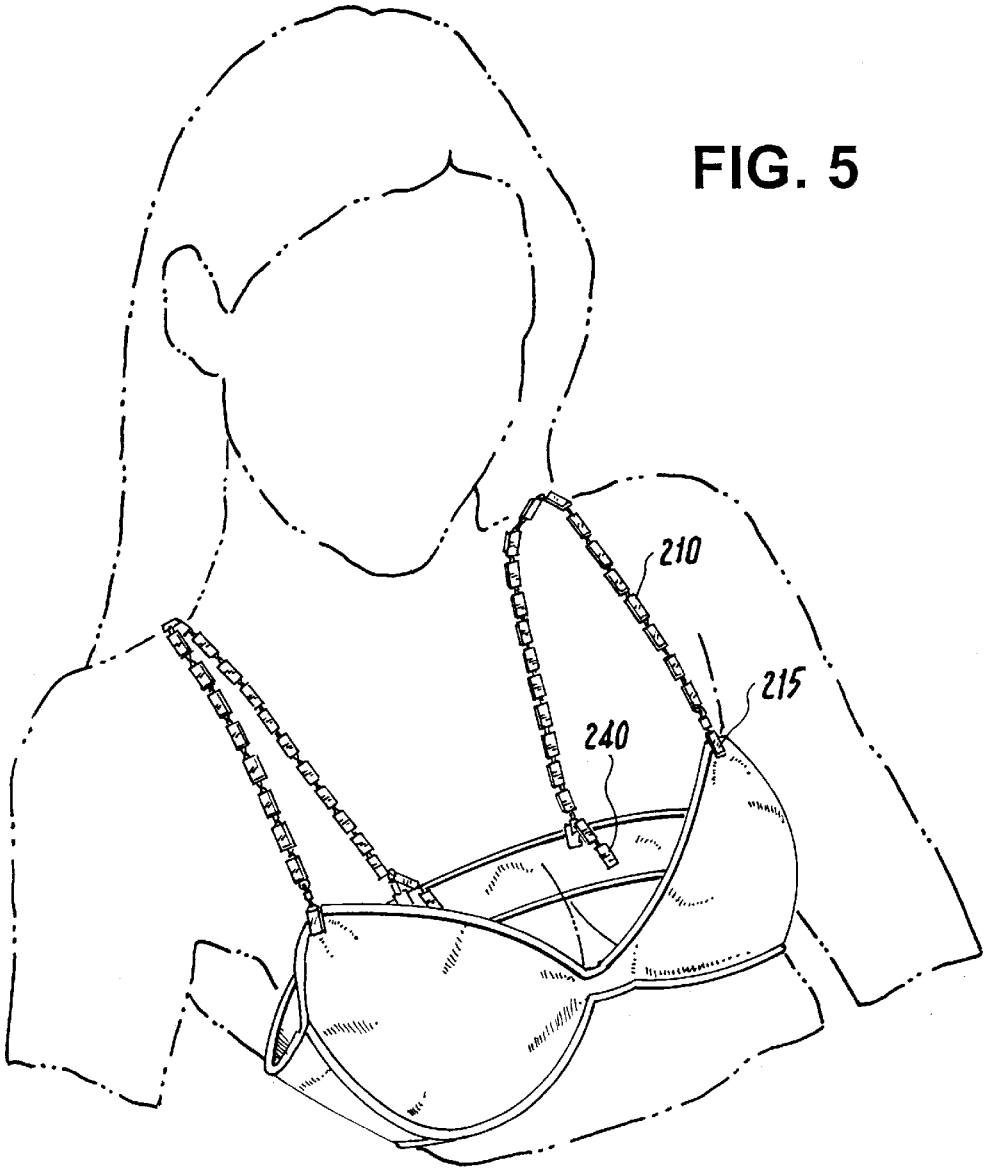
FIG. 5 illustrates an alternative embodiment of the present invention.
Figure 6:
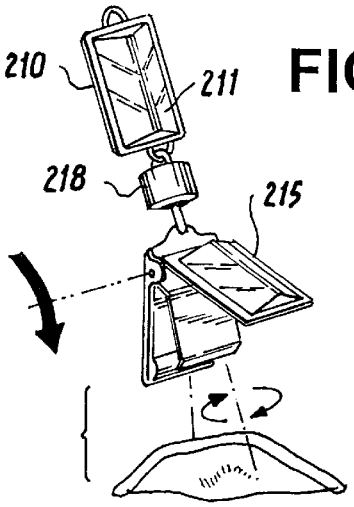
FIGS. 6 and 7 illustrate front and unattached rear clasps of the embodiment illustrated in FIG. 5, respectively.
Figure 7:
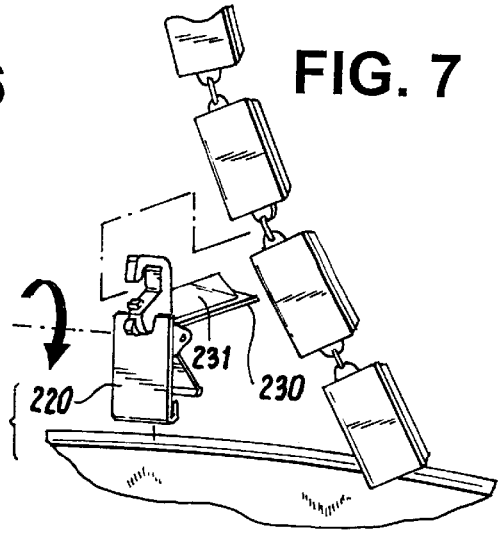

An alternative embodiment of the present invention is illustrated in FIGS. 5–7 wherein the chain comprises precious, semi-precious or costume jewelry connected in lengths. This length of chain comprises a decorative stone 211 attached to a metallic base 210. The stones can be precious stones, semi-precious stones, costume jewelry or any other decorative ornaments regardless of cost. In this illustrated embodiment, the front terminal end of the length of jewelry 210 is connected to a front garment clasp 215 which advantageously has substantially the same configuration, shape and color as the length of jewelry. In this manner, forward clasp 215 blends well with the length of jewelry 210 in an esthetically pleasing manner. This illustrated embodiment of the present invention also advantageously comprises a swivel connector 218 which permits the length of jewelry 210 to rotate freely relative to the forward connector 215. Swivel connector can be provided proximate any of the connections disclosed herein. As illustrated in FIG. 7, a rear clasp 220 is designed to engage the garment without puncturing or otherwise damaging the garment. Rear clasp 220 of this preferred embodiment of: the present invention is also designed to have substantially the same general configuration as at least a portion of the length of jewelry 210 and comprises a metallic base 230 with a stone 231 as best shown in FIG. 5. Any excess length of chain 240 does not overlap the working portion of the length of jewelry and is readily concealed behind the garment. As used herein, the term "working portion" refers to a portion of the garment support which is actually providing support to one or more garments.

Figure 8:
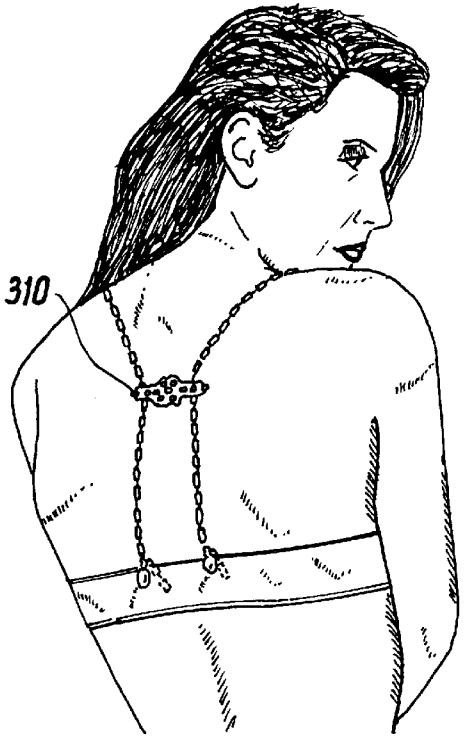
FIG. 8 illustrates a rear portion of an alternative embodiment of the present invention.

FIG. 8 illustrates an alternative embodiment of the present invention wherein two garment supports are joined by a decorative connector at an intermediate position. In this illustrated embodiment a decorative connector 310 is used to connect two lengths of jewelry.

Figure 9:
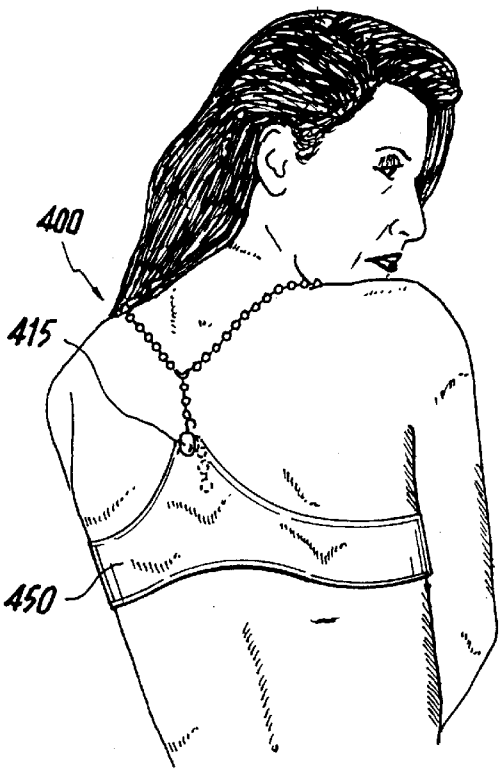
FIG. 9 illustrates the rear portion of an alternative embodiment of the present invention.

A further embodiment of the present invention is illustrated in FIG. 9 wherein a generally Y-shaped garment support 400 comprises an adjustable clasp 415 of the type generally illustrated in FIGS. 2 and 4 to connect a rear portion of the support to a garment 450. In this illustrated embodiment, the support attaches at one point in the rear of the garment and at two forward positions (not shown). The forward sections of the support 400 can be connected with either fixed terminal connectors such as the clasp shown in FIG. 3, or can permit adjustability of the garment support in the front utilizing a garment connector such as clasp 120 illustrated in FIG. 4.

Figure 10:
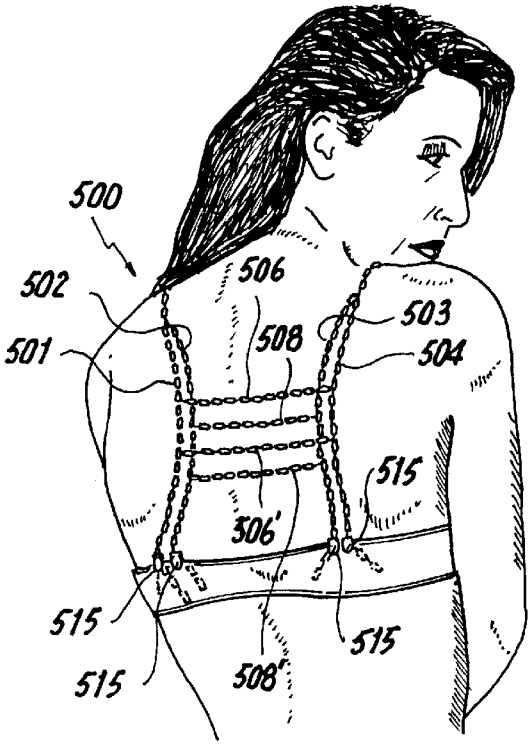
FIG. 10 illustrates the rear portion of a still further alternative embodiment of the present invention.

FIG. 10 illustrates a still further embodiment of the present invention with a more intricate garment support 500 which utilizes a plurality of lengths of jewelry on the back of the wearer. In this illustrated embodiment, the garment support 500 comprises two forward lengths of jewelry (not shown) which are attached to a garment in one of the manners discussed above. The rear portion of the garment support 500 comprises a plurality of vertical supports with a left outermost support 501, a left inner support 502, a right inner support 503 and a right outer support 504. Each of the supports is advantageously releasably attachable to a garment utilizing an adjustable clasp 515 such as those described above. In addition, a plurality of horizontal lengths of jewelry are utilized to connect the inner and outer vertical lengths 501–504. In this illustrated embodiment, the outer left support 501 is connected with two horizontal lengths 506, 506' to the right outer support 504 and the left inner support 502 is connected with two horizontal lengths 508, 508' to the right inner support 503. It is also within the scope of the present invention to connect all four vertical supports with a single horizontal strand or to connect one inner with one outer strand. While this illustrated embodiment utilizes four horizontal strands, it is also within the scope of the present invention to utilize more or fewer horizontal lengths of jewelry to connect the vertical supports. It is also within the scope of the present invention to use a greater or fewer number of vertical supports, horizontal supports, diagonal supports and/or combinations of vertical, horizontal and/or diagonal supports in the front, back or both. The supports can also be crisscrossed either in the front, rear, or both. The particular design of the garment support will depend upon the taste of the wearer and may be influenced by the design of the garment. Additionally, while the embodiments illustrated in FIGS. 8–10 merely illustrate the back portions of garments supports, it is also within the scope of the present invention to utilize these designs on the front portion of the garment support either in combination with the rear portion shown or with single or multiple attachments to the back of the garment. It is also within the scope of the present invention to use these or other types of terminal or non-terminal connectors or adjustable connectors on either the front or rear of a garment support of the present invention. For most applications and in light of the desires for comfort of the wearer, it is contemplated that it will most often be desirable to place the adjustment connectors on the rear of a garment while the front of the garment support will have a fixed terminal connector such as those shown in FIGS. 3 and 6. However, some wearers may prefer to have an adjustable mechanism in the front for ease of use.

Figure 11:
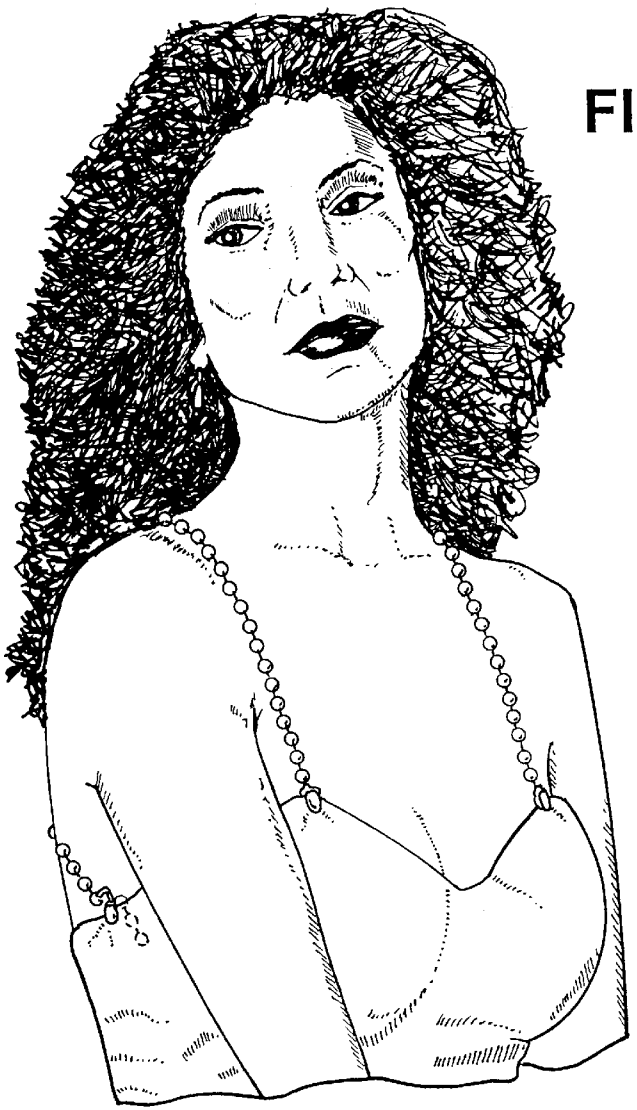
FIG. 11 illustrates another embodiment of the present invention.

FIG. 11 illustrates an alternative embodiment of the present invention wherein two garment supports are used to support a strapless dress. In this embodiment, two garment supports of the type illustrated in FIG. 2 are attached to the front and sides of the illustrated woman's garments. Therefore, from the present description, it will be appreciated that the decorative garment supports of the present invention do not necessarily have to connect to both the front and back of a garment.

Figure 12:
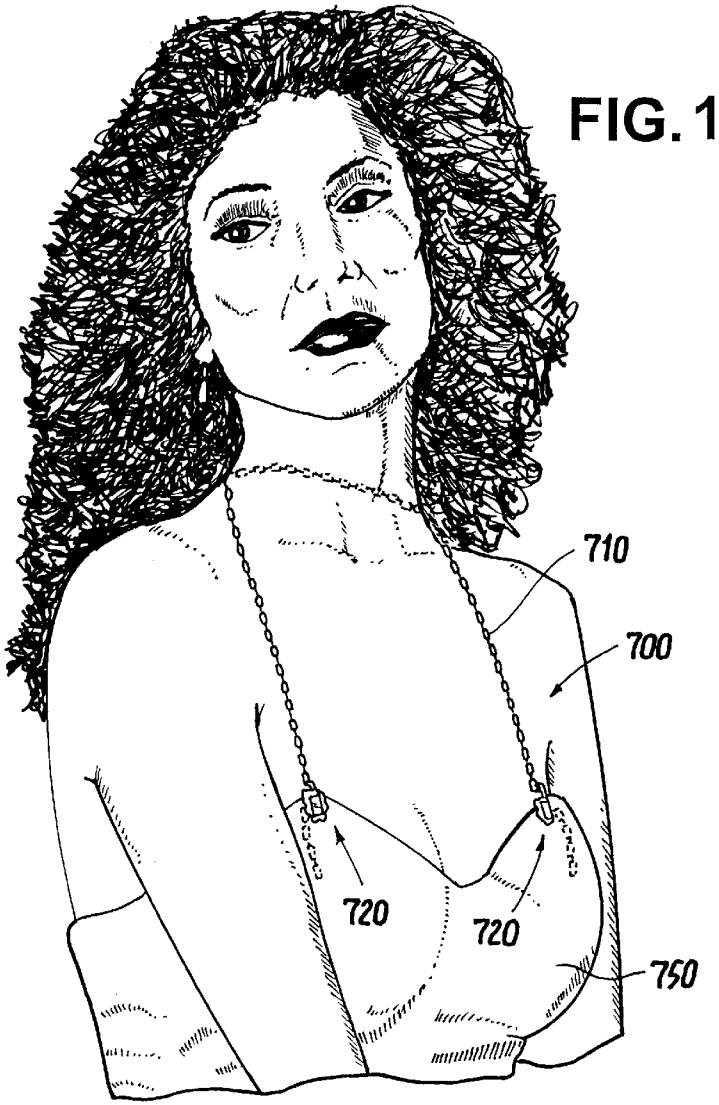
FIG. 12 illustrates a still further embodiment of the present invention.

Additionally, according to another embodiment of the present invention, a single garment support can be designed to simply pass around the neck of a wearer as illustrated in FIG. 12. In this manner, the jewelry support 700 comprises a single length of jewelry 710 which is connected to a strapless dress 750 utilizing two adjustable garment connectors 720 of the type illustrated in FIG. 7. It is also within the scope of the present invention to utilize a swivel connector, with an adjustable clasp 220. While this illustrated embodiment comprises two adjustable clasps 720, adjustment can also readily be performed with a single adjustable clasp and one fixed terminal garment connector.

One preferred aspect of the present invention comprises adjustable and interchangeable jewelry garment supports for use with different garments which promote the display of the garment supports as a piece of jewelry. The invention of adjustable and interchangeable jewelry garment supports encompasses jewelry garment supports made out of various designs and various materials regardless of cost. The adjustable and interchangeable jewelry garment supports are "adjustable" meaning that the length of the jewelry garment support can be adjusted. The adjustable and interchangeable jewelry garment supports are also "interchangeable" meaning that they can be attached and detached from one garment to another, without piercing the garment, enabling them to be worn on many different garments of different sizes, shapes, designs, and from different manufacturers. For example, embodiments of the present invention allow a woman to wear her own garment, e.g. a bra, that she is comfortable in rather than a specific replacement bra, and to wear one of many jewelry garment supports.

What is claimed is:

1. An ornamental garment support for providing vertical support to an upper body garment comprising:

a flexible, length of jewelry comprising a first end, a second end and a plurality of intermediate positions, said length of jewelry sufficiently long to pass over a person's shoulder for attachment to a front portion and a rear portion of an upper body garment;

a first selectively releasable clothing clasp connected to said first end of said length of jewelry for selectively and releasably attaching said length of jewelry to a garment; and a second releasable clothing clasp selectively and releasably attachable to a garment, said second clasp having an appearance comparable to a portion of said length of jewelry, said second clasp comprising means for selectively and releasably connecting said clasp to said length of jewelry at one of a plurality of intermediate positions, wherein said second end of said length of jewelry extends below said connecting means to avoid the visible appearance of a separate length of jewelry.

2. An ornamental garment support according to claim 1 wherein said second end of said length of jewelry extends below said second clasp.

3. An ornamental garment support according to claim 1 wherein said length of jewelry comprises costume jewelry.

4. An ornamental garment support according to claim 1 wherein said length of jewelry comprises at least one precious metal.

5. An ornamental garment support according to claim 1 wherein said length of jewelry comprises at least one semi-precious metal.

6. An ornamental garment support according to claim 1 wherein said length of jewelry comprises gems.

7. An ornamental garment support according to claim 1 wherein said length of jewelry comprises artificial gems.

8. An ornamental garment support according to claim 1 wherein said length of jewelry comprises pearls.

9. An ornamental garment support according to claim 1 wherein said length of jewelry comprises a plurality of links.

10. An ornamental garment support according to claim 1 wherein said connecting means comprises a hook fastener.

11. An ornamental garment support according to claim 1 comprising a plurality of flexible lengths of jewelry each comprising a first end, a second end and a plurality of intermediate positions;

a first releasably clothing clasp connected to each of said first ends of said length of jewelry for selectively and releasably attaching said length of jewelry to a garment; and a plurality of second releasable clothing clasps selectively and releasably attachable to a garment, said second clasps comprising means for selectively and releasably connecting said clasp to one of said length of jewelry at one of a plurality of intermediate positions, wherein said second ends of said length of jewelry extend below said connecting means.

12. An ornamental garment support according to claim 11 further comprising an ornamental element connecting said linear lengths.

13. An ornamental garment support according to claim 12 wherein said ornamental element comprises a flexible length of jewelry.

14. An ornamental garment support according to claim 12 wherein said ornamental element comprises a plurality of flexible lengths of jewelry.

15. An ornamental garment support according to claim 12 wherein said ornamental element comprises an ornamental clip.

16. An ornamental garment support according to claim 11 wherein said length of jewelry is substantially Y-shaped.

17. An ornamental garment support according to claim 11 wherein at least one of said clasps has substantially the same configuration as a portion of said length of jewelry.

18. An ornamental garment support according to claim 11 wherein a plurality of said clasps have substantially the same configuration as a portion of said length of jewelry.

19. An ornamental garment support according to claim 11 further comprising at least one swivel connector.

20. An ornamental garment support according to claim 1 wherein said clasp does not pierce a garment.

21. An ornamental garment support according to claim 1 comprising a plurality of flexible lengths of jewelry, each of said lengths of jewelry comprising at least two clasps.

22. An ornamental garment support according to claim 21 further comprising means for connecting at least two of said flexible lengths of jewelry.

23. An ornamental garment support according to claim 22 wherein said connecting means is substantially horizontal.

24. An ornamental garment support according to claim 22 wherein said connecting means is substantially vertical.

25. An ornamental garment support according to claim 22 wherein said connecting means is substantially diagonal.

26. An ornamental garment support according to claim 22 wherein said connecting means is disposed on the front of the person wearing the ornamental garment support.

27. An ornamental garment support according to claim 22 wherein said connecting means is disposed on the rear of the person wearing the ornamental garment support.

28. An ornamental garment support for providing vertical support to an upper body garment comprising:

a flexible, length of jewelry comprising a first end, a second end and a plurality of intermediate positions, said length of jewelry sufficiently long to pass over a person's shoulder for attachment to a front portion and a rear portion of an upper body garment;

a first releasable clothing clasp comprising means for selectively and releasably connecting said clasp to said length of jewelry at one of a plurality of intermediate positions and means for selectively and releasably connecting said clasp to a garment; and a second releasable clothing clasp selectively and releasably attachable to a garment, said second clasp having an appearance comparable to a portion of said length of jewelry, said second clasp comprising means for selectively and releasably connecting said clasp to said length of jewelry at one of a plurality of intermediate positions for adjusting the operative length of said strand, and means for selectively and releasably connecting said clasp to a garment wherein said second end of said length of jewelry extends below said connecting means to avoid the visible appearance of a separate length of jewelry.

29. An ornamental garment support according to claim 28 wherein said second end of said length of jewelry extends below said second clasp.

30. An ornamental garment support according to claim 28 wherein said first end of said length of jewelry extends below said first clasp.

31. An ornamental garment support according to claim 28 wherein said length of jewelry comprises costume jewelry.

32. An ornamental garment support according to claim 28 wherein said length of jewelry comprises at least one precious metal.

33. An ornamental garment support according to claim 28 wherein said length of jewelry comprises at least one semi-precious metal.

34. An ornamental garment support according to claim 28 wherein said length of jewelry comprises gems.

35. An ornamental garment support according to claim 28 wherein said length of jewelry comprises artificial gems.

36. An ornamental garment support according to claim 28 wherein said length of jewelry comprises pearls.

37. An ornamental garment support according to claim 28 wherein said length of jewelry comprises a plurality of links.

38. An ornamental garment support according to claim 28 wherein said connecting means comprises a hook connector.

39. An ornamental garment support according to claim 28 further comprising at least one swivel connector.

40. An ornamental garment support according to claim 28 wherein said clasp does not pierce a garment.

41. An ornamental garment support according to claim 28 comprising a plurality of flexible lengths of jewelry, each of said lengths of jewelry comprising at least two clasps.

42. An ornamental garment support according to claim 41 further comprising means for connecting at least two of said flexible lengths of jewelry.

43. An ornamental garment support according to claim 42 wherein said connecting means is substantially horizontal.

44. An ornamental garment support according to claim 42 wherein said connecting means is substantially vertical.

45. An ornamental garment support according to claim 42 wherein said connecting means is substantially diagonal.

46. An ornamental garment support according to claim 42 wherein said connecting means is disposed on the front of the person wearing the ornamental garment support.

47. An ornamental garment support according to claim 42 wherein said connecting means is disposed on the rear of the person wearing the ornamental garment support.

48. An ornamental garment support for providing vertical support to an upper body garment comprising:

a flexible, length of jewelry comprising a first end, a second end and a plurality of intermediate positions, said length of jewelry sufficiently long to pass over a person's shoulder for attachment to a front portion and a rear portion of an upper body garment;

a first releasable clothing clasp connected to said first end of a said length of jewelry for selectively and releasably attaching said first end of said length of jewelry to a garment;

a second releasable clothing clasp connected to said second end of said length of jewelry for selectively and releasably attaching said second end of said length of jewelry to a garment; and a third releasable clothing clasp selectively and releasably attachable to a garment, said third clasp having an appearance comparable to a portion of said length of jewelry, said third clasp comprising means for selectively and releasably connecting said clasp to said length of jewelry at one of a plurality of intermediate positions, wherein said third end of said length of jewelry extends below said connecting means to avoid the visible appearance of a separate length of jewelry.

49. An ornamental garment support according to claim 48 herein said second end of said length of jewelry extends below said second clasp.

50. An ornamental garment support according to claim 48 wherein said length of jewelry comprises costume jewelry.

51. An ornamental garment support according to claim 48 wherein said length of jewelry comprises at least one precious metal.

52. An ornamental garment support according to claim 48 wherein said length of jewelry comprises at least one semi-precious metal.

53. An ornamental garment support according to claim 48 wherein said length of jewelry comprises gems.

54. An ornamental garment support according to claim 48 wherein said length of jewelry comprises artificial gems.

55. An ornamental garment support according to claim 48 wherein said length of jewelry comprises pearls.

56. An ornamental garment support according to claim 48 wherein said length of jewelry comprises a plurality of links.

57. An ornamental garment support according to claim 48 wherein said connecting means comprises a hook connector.

58. An ornamental garment support according to claim 48 further comprising at least one swivel connector.

59. An ornamental garment support according to claim 48 wherein said clasp does not pierce a garment.

60. An ornamental garment support according to claim 48 comprising a plurality of flexible lengths of jewelry, each of said lengths of jewelry comprising at least two clasps.

61. An ornamental garment support according to claim 60 further comprising means for connecting at least two of said flexible lengths of jewelry.

62. An ornamental garment support according to claim 61 wherein said connecting means is substantially horizontal.

63. An ornamental garment support according to claim 61 wherein said connecting means is substantially vertical.

64. An ornamental garment support according to claim 61 wherein said connecting means is substantially diagonal.

65. An ornamental garment support according to claim 61 wherein said connecting means is disposed on the front of the person wearing the ornamental garment support.

66. An ornamental garment support according to claim 61 wherein said connecting means is disposed on the rear of the person wearing the ornamental garment support.

67. An ornamental garment support in combination with an upper body garment, said garment support providing vertical support to said garment, comprising:

an upper body garment;

an ornamental garment support comprising:

a flexible, length of jewelry comprising a first end, a second end and a plurality of intermediate positions, said length of jewelry sufficiently long to pass over a person's shoulder for attachment to a front portion and a rear portion of said upper body garment;

a first selectively releasable clothing clasp connected to said first end of said length of jewelry and selectively and releasably attached to a first upper portion of said garment; and a second selectively releasable clothing clasp connected to a second upper portion of said garment, said second clasp having an appearance comparable to a portion of said length of jewelry, and selectively and releasably connected to said length of jewelry at one of a plurality of intermediate positions, wherein said second end of said length of jewelry extends below said connecting means to avoid the visible appearance of a separate length of jewelry.

68. An ornamental garment support for providing vertical support to an upper body garment comprising:

a flexible, length of jewelry comprising a first end, a second end and a plurality of intermediate positions, said length of jewelry sufficiently long to pass over a person's shoulder for attachment to a front portion and a side portion of an upper body garment;

a first selectively releasable clothing clasp connected to said first end of said length of jewelry for selectively and releasably attaching said length of jewelry to a garment; and a second releasable clothing clasp selectively and releasably attachable to a garment, said second clasp having an appearance comparable to a portion of said length of jewelry, said second clasp comprising means for selectively and releasably connecting said clasp to said length of jewelry at one of a plurality of intermediate positions, wherein said second end of said length of jewelry extends below said connecting means to avoid the visible appearance of a separate length of jewelry.

69. An ornamental garment support for providing vertical support to an upper body garment comprising:

a flexible, length of jewelry comprising a first end, a second end and a plurality of intermediate positions, said length of jewelry sufficiently long to pass around a person's neck for attachment to a first front portion and a second front portion of an upper body garment;

a first selectively releasable clothing clasp connected to said first end of said length of jewelry for selectively and releasably attaching said length of jewelry to a garment; and a second releasable clothing clasp selectively and releasably attachable to a garment, said second clasp having an appearance comparable to a portion of said length of jewelry, said second clasp comprising means for selectively and releasably connecting said clasp to said length of jewelry at one of a plurality of intermediate positions, wherein said second end of said length of jewelry extends below said connecting means to avoid the visible appearance of a separate length of jewelry.

* * * * *